United States Patent [19]

Evans et al.

[11] 4,129,920

[45] Dec. 19, 1978

[54] HOSE COUPLING FOR UPRIGHT VACUUM CLEANER

[75] Inventors: Robert A. Evans; James W. Momberg, both of Stamford, Conn.

[73] Assignee: Consolidated Foods Corporation, Old Greenwich, Conn.

[21] Appl. No.: 859,888

[22] Filed: Dec. 12, 1977

[51] Int. Cl.[2] ..... A47L 5/32

[52] U.S. Cl. ..... 15/337; 15/410

[58] Field of Search ..... 15/331, 334, 337, 410

[56] References Cited

U.S. PATENT DOCUMENTS

| | | | |
|---|---|---|---|
| 2,397,537 | 4/1946 | Coss | 15/410 |
| 2,460,236 | 1/1949 | Osborn | 15/410 |
| 2,618,007 | 11/1952 | Fuller | 15/337 X |
| 2,867,833 | 1/1959 | Duff | 15/337 X |
| 3,639,939 | 1/1972 | Crener et al. | 15/337 X |

*Primary Examiner*—Christopher K. Moore

*Attorney, Agent, or Firm*—William S. Henry

[57] ABSTRACT

In accordance with the present invention, there is provided an arrangement for attaching a suction hose to an enclosed bag type of upright vacuum cleaner for the purpose of above-the-floor cleaning.

5 Claims, 5 Drawing Figures

FIG. 3
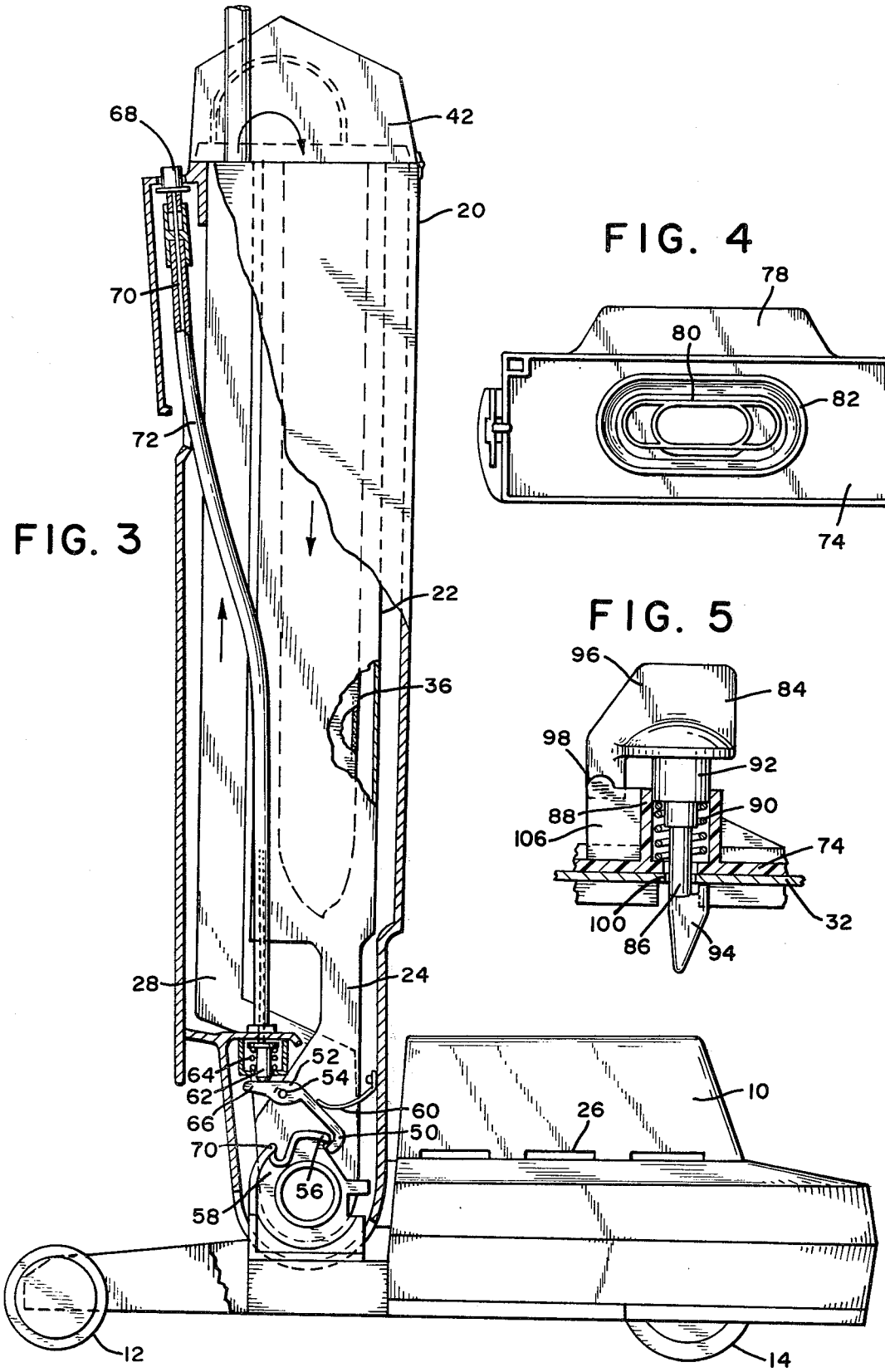
FIG. 4
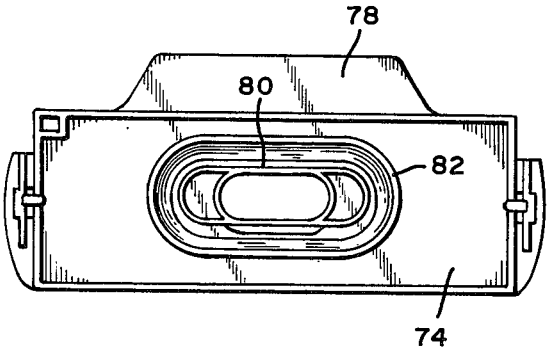
FIG. 5

HOSE COUPLING FOR UPRIGHT VACUUM CLEANER

BACKGROUND

A great many arrangements have been proposed and some have been used for connecting a hose to an upright vacuum cleaner for above-the-floor cleaning, but most have been for so-called bag-on-handle upright cleaners where the dust bag is not enclosed and the fan is between the floor nozzle and the bag in the line of air flow. In a cleaner of this type, the problems of connecting a hose are quite different from those encountered with an enclosed bag upright where the bag is between the floor nozzle and the fan. An example of the latter type is shown in U.S. Pat. No. 2,867,833 issued Jan. 13, 1959, to J. E. Duff.

SUMMARY OF THE INVENTION

The present invention involves a dust bag enclosure provided with a hinged cover which, when closed, provides a passageway connecting a conduit leading from the floor nozzle to the inlet opening of the bag and, when opened, permits removal of the bag. In combination with this is a hose connection member or adaptor which, when the hinged cover is open, may be secured to the dust bag enclosure so as to by-pass the conduit leading from the nozzle and to provide a connection for a suction hose leading to the inlet opening of the bag.

DESCRIPTION OF THE FIGURES

FIG. 3 is a side view, partially in cross-section, of the vacuum cleaner shown in FIG. 1, but with the adaptor removed and the dust bag cover closed;

FIG. 4 is a bottom view of the adaptor shown in FIGS. 1 and 2; and

FIG. 5 is a cross-sectional view on an enlarged scale taken on the line 5—5 of FIG. 2.

Figure 1:
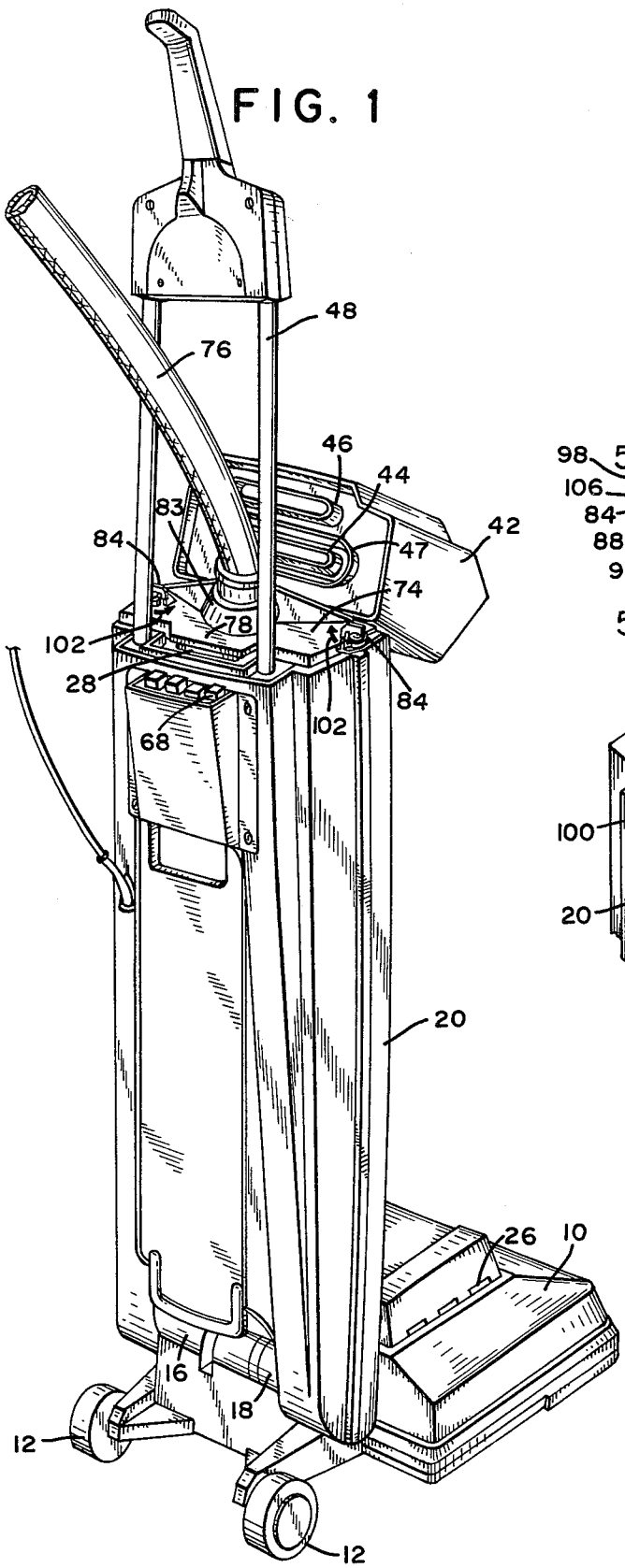
FIG. 1 is a perspective view of an upright vacuum cleaner embodying our invention with the dust bag cover open and a suction hose connection adaptor secured in place with a suction hose connected thereto.

Referring to the drawings, reference character 10 designates generally the base of an upright vacuum cleaner which is adapted to be supported on a horizontal surface, such as a floor to be cleaned, by wheels 12 and 14. Within base 10 is a high speed electric motor for driving a suction fan (not shown). The lower horizontal surface of base 10 is formed with the usual suction nozzle opening through which air is drawn for picking up and entraining dirt from the floor being cleaned.

Pivotally secured to the base 10 by means of hollow trunions 16 and 18 is an elongated dust bag enclosure 20 having an inner airtight body 22, the lower end of which is connected through a conduit 24 and hollow trunion 18 with the inlet of the suction fan in base 10. The outlet of the fan discharges to atmosphere through suitable vents 26. The suction nozzle opening in base 10 is connected through hollow trunion 16 with a conduit 28 which extends to the upper end of enclosure 20. The upper end wall 32 of enclosure 20 is formed with rectangular opening 34 for receiving a disposable dust bag 36 to the upper end of which is secured a stiff rectangular disc 38 which is larger than opening 34 so that it rests on the exterior of wall 32 to support the dust bag. Disc 38 is formed with a rectangular opening 40 which serves as an inlet to bag 36. Hinged to the forward edge of end wall 32 is a hollow cover 42 which may be pivoted clockwise from the position shown in FIG. 3 to that shown in FIG. 1 so as to uncover the upper end of the enclosure, which permits removal of bag 36 when filled and replacement by a clean bag. Cover 42 has an elongated hollow nozzle-like projection 44 so located and of the paper size to enter inlet 40 in dust bag disc 38 when the cover is closed. Nozzle 44 is surrounded by a flexible gasket 47 which bears against disc 38 so as to provide an airtight seal. Cover 40 also has a nozzle-like projection 46 of flexible material which enters the upper end of conduit 28 when the cover is closed to thus provide a connection from conduit 28 through cover 42, nozzle 44 and inlet 40 to the interior of dust bag 36.

Secured to the upper end of bag enclosure 20 is a manipulating handle 48 which is used to move and guide the base 10 over a floor surface being cleaned. As previously stated, enclosure 20 is pivotally connected to base 10 by hollow trunions 16 and 18 but may be retained in a vertical position by the engagement of the hooked end 50 of a lever 52, pivoted at 54 on the lower part of enclosure 20, with tooth 56 of a ratchet 58 secured to base 10, a leaf spring 60 urging lever 52 into engagement with ratchet 58. A plunger 62 urged upwardly by a coil spring 64, bears against end 66 of the lever and may be moved downwardly by manual force transmitted from a button 68 located near the top of enclosure 20 through a stiff wire 70 in a tube 72. Such movement pivots lever 52 counter-clockwise to disengage hooked end 50 from tooth 56, whereupon enclosure 20 may be pivoted counter-clockwise, as viewed in FIGS. 1 and 3, with respect to base 10. If pressure on button 68 is relieved as soon as enclosure 20 has been pivoted a few degrees from the vertical, it may be pivoted downwardly until it reaches an angle of about 45°, whereupon end 50 engages a second tooth 70 on the ratchet to retain the enclosure at this angle. If it is desired to lower the enclosure 20 to a substantially horizontal position in order to clean under furniture, hooked end 50 may be released from tooth 70 by again depressing button 68.

Reference character 74 designates generally an adaptor for making it possible to connect a flexible suction hose 76 to enclosure 20 for above-the-floor cleaning. Adaptor 74 is of a size and shape to cover the upper end of enclosure 20 when cover 42 is pivoted to the open position shown in FIG. 1, and has an extension 78 for covering off the upper end of conduit 28 which leads from the suction nozzle opening in base 10. As shown particularly in FIG. 4, the underside of the adaptor has a hollow nozzle-like projection 80 surrounded by a gasket 82 corresponding to the nozzle 44 and gasket 47 of cover 42. Adaptor 76 is formed with the female portion 83 of a separable coupling, which is adapted to receive the male portion 85 on the end of hose 76. Coupling portion 83 communicates directly with nozzle 80.

Adaptor 74 may be secured to the upper end of enclosure 20 with nozzle 80 extending into opening 40 in dust bag disc 38 by a pair of latches designated generally by reference character 84, one of which is shown in detail in FIG. 5. Each latch includes a shaft portion 86 which extends through an opening in adaptor 74, the opening being located in the bottom of a hollow cylindrical projection 88 within which is located a coil spring 90 bearing against a cylindrical enlargement 92 on shaft 86 to bias the latch upwardly. The lower end of shaft 86 is formed as a pointed flat hook 94, while secured to the upper end is handle 96 from one side of which depends a projection 98.

Figure 2:
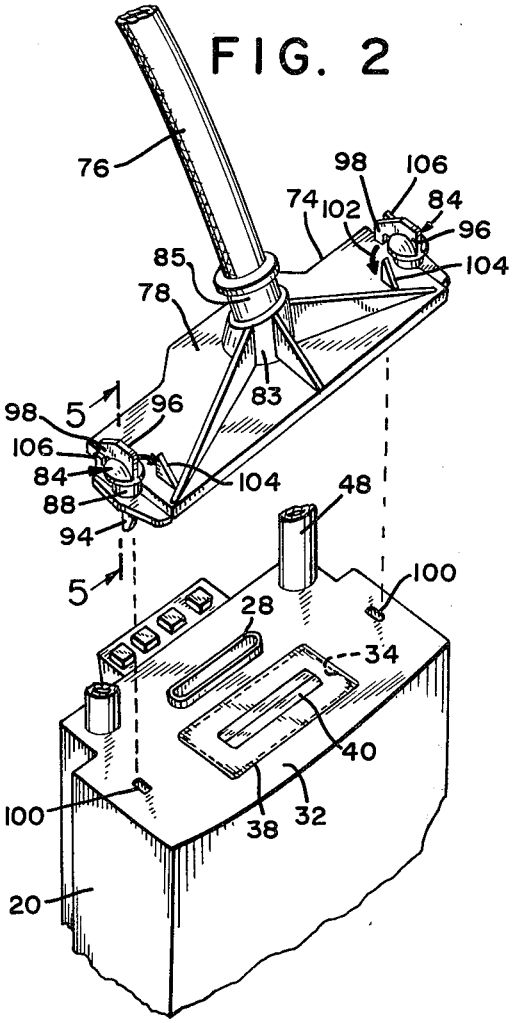
FIG. 2 is an exploded view showing the hose connection adaptor removed from the dust bag enclosure.

When both latches 84 are in the position shown in FIG. 2, that is, with the flat hooks 84 extending crosswise of adaptor 74, the latter may be placed on the upper end of enclosure 20 with nozzle 80 entering opening 40 in the dust bag disc and the hooks 94 entering elongated slots 100 formed in upper wall 32 outwardly from inner body 22. The latches 84 are then pressed downwardly against the bias of springs 90 and turned 90° in the directions of arrows 102, whereupon projections 98 engage a pair of abutments 104 on adaptor 74 to prevent further turning. Hooks 94 now extend crosswise of slots 100 and engage the underside of wall 32 and are forced upwardly thereagainst by springs 90, thus locking adaptor 74 in place.

Any suitable above-the-floor cleaning tool or nozzle may be attached to the end of hose 76 and used for removing dust from furniture, drapes, lamp shades, baseboards, radiators, or any other objects or surfaces which cannot be reached by the floor nozzle in base 10. The dirt so removed is conveyed by the air stream through hose 76 and nozzle 80 directly into dust bag 36 where it is retained, the air passing through the filter material of the bag and through conduit 24 and trunion 18 to the inlet of the fan in base 10. Enclosure 20 may be held in the upright position shown in FIGS. 1 and 3, or it may be lowered half way or all the way to a horizontal position by depressing button 68 to release hook 50, as previously described. A lowered position of enclosure 20 is usually more convenient if the object to be cleaned is near the floor, such as a baseboard, and with the enclosure in such position, the entire cleaner may be pulled on wheels 12 and 14 around on the floor by means of hose 76.

When it is desired to remove adaptor 74, the latches 84 are turned in the opposite directions until the projections 98 engage a second pair of abutments 106. This brings the flat hooks 94 into alignment with elongated slots 100, whereupon springs 90 raise the latches so that the hooks cannot reengage the underside of wall 32, and the adaptor 74 may be removed from enclosure 20. Cover 42 may then be pivoted to the closed position shown in FIG. 3, and the vacuum cleaner is operable for cleaning a floor.

While we have shown and described a more or less specific embodiment of our invention, it is to be understood that this is for the purpose of illustration only and that the scope of our invention is not to be limited thereby, but is to be determined from the appended claims.

We claim:

1. In a vacuum cleaner of the upright type, a base member, means for movably supporting said member on a substantially horizontal surface, an elongated enclosure pivotally secured to said base member, said enclosure having an upper end wall formed with an opening to the interior of the enclosure, a dust bag insertable into and removable from said enclosure through said opening, said bag having a stiff end member larger than said opening to thereby rest on the exterior of said wall and being formed with an inlet to the interior of said bag, a conduit within said enclosure having an upper end terminating in a second opening in said end wall, a cover hinged to one edge of said wall and formed with a passageway connecting said second opening to said inlet when the cover is closed, an adaptor, means for securing said adaptor to said end wall when said cover is open, said adaptor having a passage therethrough communicating with said inlet and a portion covering said second opening, and means for connecting a flexible suction hose to said adaptor and in communication with the outer end of said passage.

2. A vacuum cleaner as defined in claim 1 including means for selectively retaining said enclosure in a vertical position or at an angle thereto so that said cleaner may be moved around on said surface by means of said hose when said enclosure is in the latter position.

3. A vacuum cleaner as defined in claim 2 in which said means for selectively retaining said enclosure includes a ratchet fixed to said base member, a hook pivotally mounted on said enclosure, a spring urging said hook into engagement with said ratchet, a plunger movable against said hook to disengage the latter from said ratchet, and manually operable means accessible near the upper end of said closure for moving said plunger.

4. A vacuum cleaner as defined in claim 1, including an airtight inner body within said enclosure for receiving said dust bag, said conduit being disposed between an outer wall of said body and an inner wall of said closure.

5. A vacuum cleaner as defined in claim 4 in which said means for securing said adaptor to said end wall includes manually operable spring-biased latches carried by said adaptor and engageable in slots formed in said end wall, said slots being disposed outwardly from said airtight inner body.

* * * * *